United States Patent [19]

Bretschneider et al.

[11] 4,395,895

[45] Aug. 2, 1983

[54] SKEW ROLLING MILL FOR REDUCING SOLID AND HOLLOW CROSS-SECTIONS

[75] Inventors: Erich Bretschneider, Meerbusch; Hermann Leitner, Langenfeld, both of Fed. Rep. of Germany

[73] Assignee: SMS Schloemann-Siemag Aktiengesellschaft, Dusseldorf, Fed. Rep. of Germany

[21] Appl. No.: 305,350

[22] Filed: Sep. 24, 1981

[30] Foreign Application Priority Data

Oct. 11, 1980 [DE] Fed. Rep. of Germany ..... 3038488
Nov. 27, 1980 [DE] Fed. Rep. of Germany ..... 3044672

[51] Int. Cl.[3] ..... B21B 31/16
[52] U.S. Cl. ..... 72/78; 72/121
[58] Field of Search ..... 72/78, 120, 121

[56] References Cited

U.S. PATENT DOCUMENTS 1,187,575 6/1916 Ward ..... 72/121
1,368,413 2/1921 Stiefel ..... 72/78
1,436,489 11/1922 Ferrier ..... 72/121
1,874,995 8/1932 Heinauer ..... 72/78
3,367,159 2/1968 Youtz ..... 72/78

FOREIGN PATENT DOCUMENTS 1277278 6/1972 United Kingdom ..... 72/121

*Primary Examiner*—Lowell A. Larson
*Attorney, Agent, or Firm*—Holman & Stern

[57] ABSTRACT

A skew rolling mill has three taper rolls, inclined at an angle to the axis of the rolled stock and offset relative to each other by 120°. Each taper roll is driven through a bevel gear pair, intermediate shaft, intermediate gear and a planet gear, from a sun gear disposed on a rotatable hollow shaft. The roll and its drive are combined by means of a casing into a roll head. The casings are rockers which can pivot along the end face of the roll support and have pivot axes disposed outside the axes of the intermediate gears, in or near the common plane of the axes of the associated intermediate gear and planet gear. These pivot axes can be adjusted to a small extent in a guide extending perpendicularly to the common plane.

12 Claims, 10 Drawing Figures

SKEW ROLLING MILL FOR REDUCING SOLID AND HOLLOW CROSS-SECTIONS

The invention relates to a skew rolling mill of the kind in which a hollow shaft, adapted to permit the passage therethrough of the rolled stock, is provided with a driven roll support (rotor), comprising three tapered working rolls, inclined relative to the axis of the rolled stock and offset relative to each other by 120°, and the said working rolls are each driven by a respective one of three planet gears which, as the roll support (rotor) rotates, roll on a sun gear on the hollow shaft. Such planetary skew rolling mills have been found equally suitable for heavy-duty forming of semifinished stock, i.e. solid cross-sections, and for the reduction of tubular stock.

The working rolls can be adjusted relative to the rolled stock in order to obtain a cross-section of the desired dimension, or a hollow cross-section of the desired external diameter—the internal diameter being defined by a mandrel rod.

The feed motion of the rolled stock is the result of the slanting position of the rolls: the axes of the shafts that support the working rolls cross the axis of the rolled stock at short distances from the latter. The roll heads which support the working roll shafts are mounted on the roll support (rotor) so as to be pivotable about axes which are parallel with the axis of the rolled stock.

To provide a drive connection to the planet gear associated with a working roll, each roll head is provided with an intermediate shaft, parallel with the axis of the rolled stock, to support an intermediate gear which meshes with the planet gear and a bevel pinion which meshes with a bevel gear disposed on the roll shaft.

The slanting position of the rolls, which defines the feed motion of the rolled stock, calls for a specific ratio of roll speed and rotor speed if the rolled stock is to pass through the rolling mill without being rotated, given a specific screw-down of the rolls and the diameter of the rolled stock defined thereby. The hollow shaft together with a sun gear disposed thereon is rotatable and the ratio between the roll speed and rotor speed can be controlled so as to avoid rotation of the rolled stock with a different screw-down or skew position of the rolls.

In known planet gear skew rolling mills constructed as described above, screw-down of the rolls is effected by axial adjustment thereof in that either the shaft with the roll disposed thereon is adjusted in its entirety by means of an adjusting device acting on the thrust bearing which provides axial support for the shaft (German Auslegeschrift No. 16 02 153) or a sliding bush, disposed on the shaft and adapted to support the roll, is axially adjusted by means of screwthreading (German Patent Specification No. 20 09 867), while adjustment of the skew position of the rolls is obtained by rotation of the roll head casing, to which end the latter bears with an extension, coaxial with the intermediate shaft, in a central bore of identical size in the roll support and can be pivoted about the axis of the intermediate shaft. The adjusting means, more particularly the adjusting means which must be provided in the roll heads and are required for the axial adjustment of the rolls, call for a degree of structural complexity of the roll heads themselves and the space required for accommodating the adjusting means is in design competition with the space required for rugged constructions of the roll shaft together with the bevel gear mounted thereon and its bearing.

It is the object of the invention to permit axial adjustment of the rolls, where the adjusting means are disposed outside the space occupied by the drive and the bearing of the roll shaft, i.e. outside the roll head casing.

According to the invention the casing of each roll head is constructed as a rocker, which is pivotable relative to the axes of the sun wheel, planet gears and intermediate gears along a normal plane, which is parallel with the end face of the roll support (rotor), and the pivot axis of said rocker is outside the axis of the associated intermediate gear and is in or near the common plane of the axes of the intermediate gear supported by said rocker and of the associated planet gear, is supported by a guide perpendicular to the said common plane, and is adjustable to both sides of the common plane of the axes within narrow limits, which ensure meshing of the intermediate gear with the planet gear.

Pivoting of the roll heads about pivot axes disposed outside the axes of the intermediate gears, as provided in accordance with the invention, results in a slight change of skew position of the rolls relative to the change of distance of the rolls from the axis of the rolled stock, by contrast to known means for pivoting the roll heads about the axes of the intermediate shaft, where the skew position of the rolls is simultaneously substantially altered—pivoting in this case is for the purpose of changing the skew position and always calls for correction of the axial adjustment of the rolls in order to compensate the change of distance of the rolls from the axis of the rolled stock.

Within the scope of the invention, any position of the pivot axis is possible, provided it is situated sufficiently far outside the axis of the intermediate wheel supported by the rocker, and positions outside the pitch circle of the intermediate wheel are in every case suitable. It is particularly advantageous if, in accordance with another feature of the invention, the guide of the pivot axis is arranged so that it intersects the axis of the planet wheel. The pivot axis and the axis of the planet wheel will then always be situated close to each other, a feature which is advantageous for the meshing conditions between the intermediate gear and planet gear; in a special case the pivot axis coincides with the axis of the planet gear. As already mentioned, the extent of change of the skew position of the rolls depends on the extent of the change of distance of the rolls from the axis of the rolled stock. If the change of distance remains within narrow limits, as is the case in some uses of planetary skew rolling mills, the change in the skew position of the rolls will remain negligibly small and in this case it is possible to dispense with adjustability of the pivot axis and the pivot axis can be made to coincide with the axis of the planet gear.

On the other hand, it can be advantageous, according to another feature of the invention, if the pivot axis in relation to the intermediate gear, is arranged diametrically opposite to the point of contact between the pitch circles of the intermediate gear and of the planet gear, since this shifts the guide of the pivot axis to the outside where there is sufficient space for the accommodation thereof and for accommodating the adjusting means. This arrangement therefore leads to a neatly grouped uncongested construction.

According to another feature of the invention, each roll head casing bears by means of an extension, adapted to accommodate the intermediate shaft bearings, in an aperture of the roll support (rotor) which permits adjustment or pivoting of the roll head casing and by means of a flange covers the said aperture in each pivoting position of the roll head casing, and the flange thereof can be fixedly clamped against the end face of the roll support. More particularly, and this is another feature of the invention, the roll support (rotor) is provided with a lantern extension which is closed by an end ring and the end ring and roll support have parallel surfaces facing each other, between which said surfaces the roll head casings are pivotably guided as rockers.

Other features of the invention will appear from the appended claims and the following detailed description of preferred embodiments of the invention shown by way of example in the accompanying drawings in which:

Figure 4:
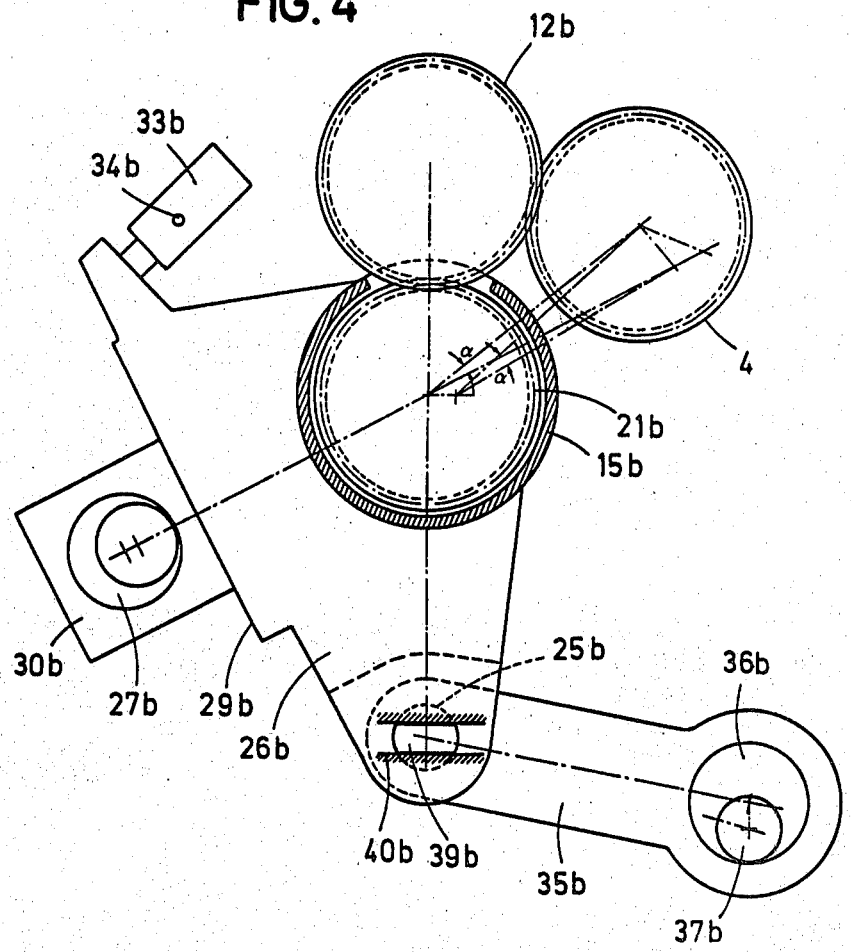
FIG. 4 shows one detail of the mill of FIGS. 1 to 3, on an enlarged scale.
Figure 5:
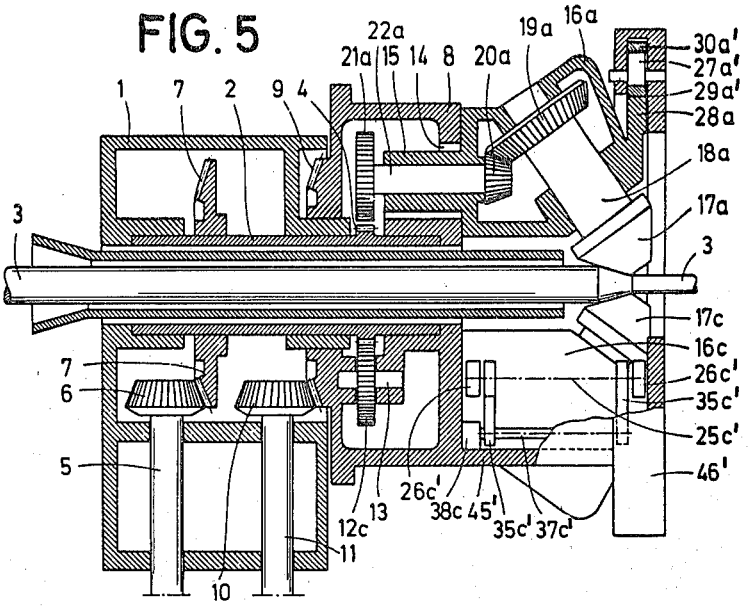
FIG. 5 shows another embodiment of the invention in diagrammatic form, in longitudinal section along the line V—V of FIG. 7.
Figure 7:
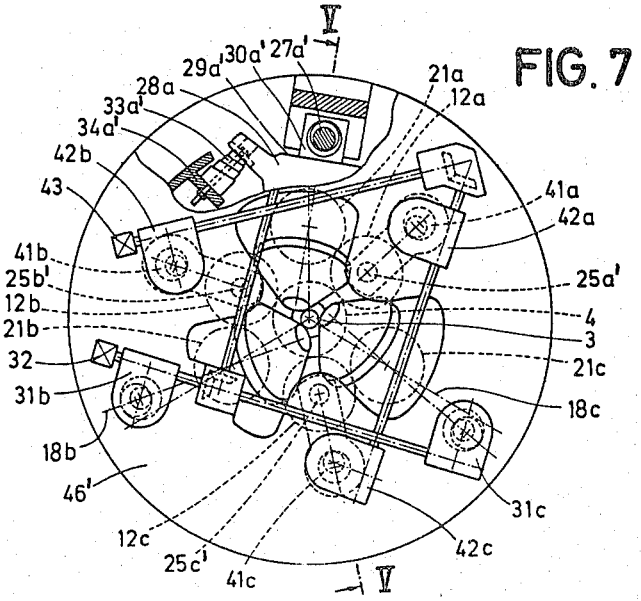
Figure 6:
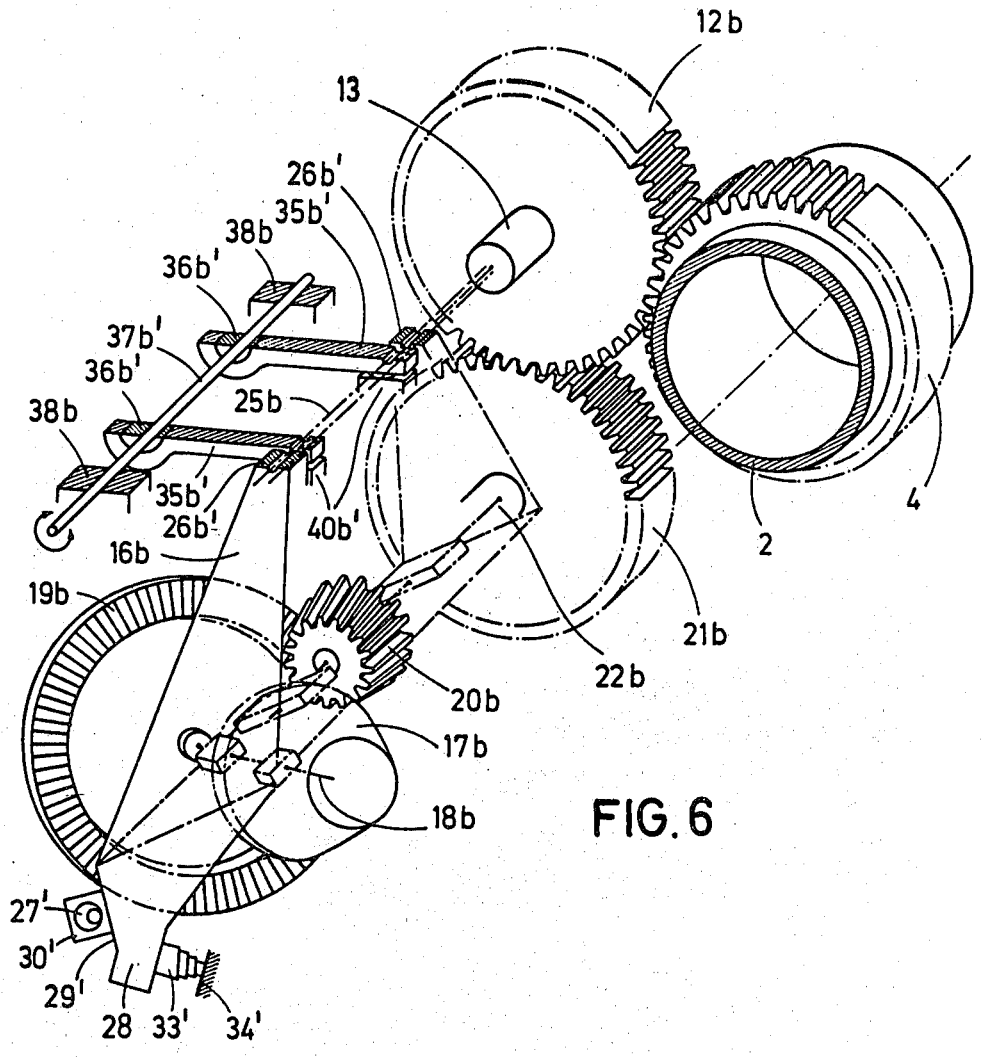
Figure 8:
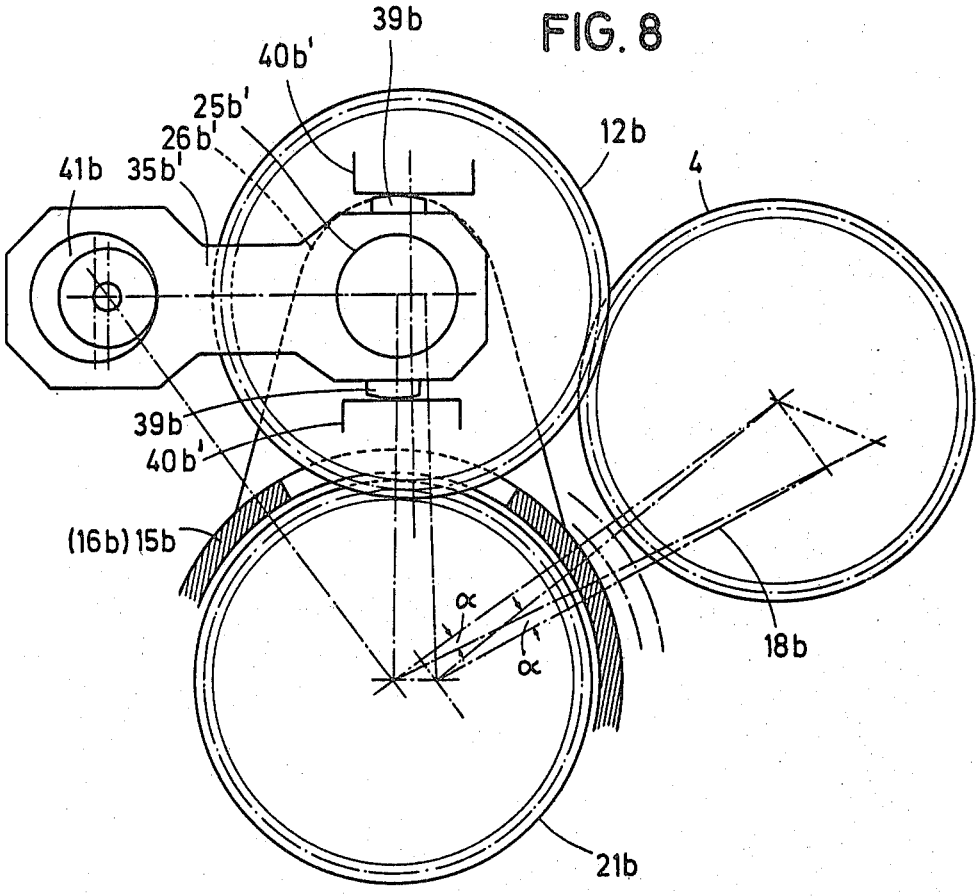
Figure 9:
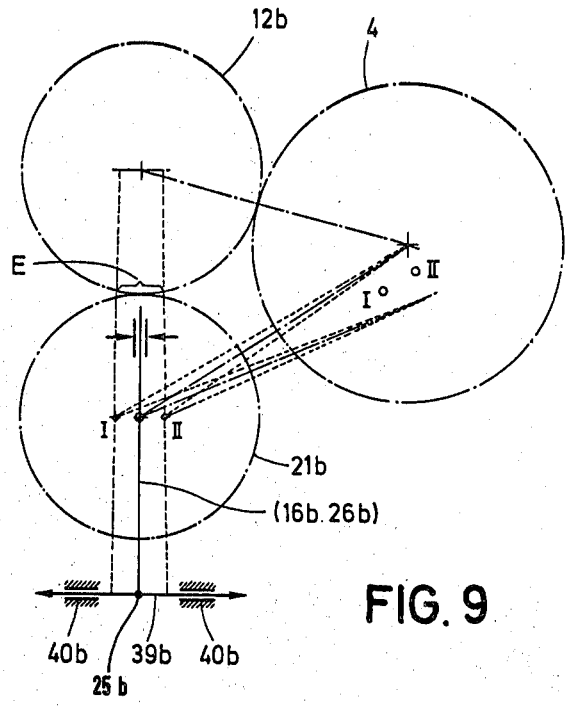
Figure 10:
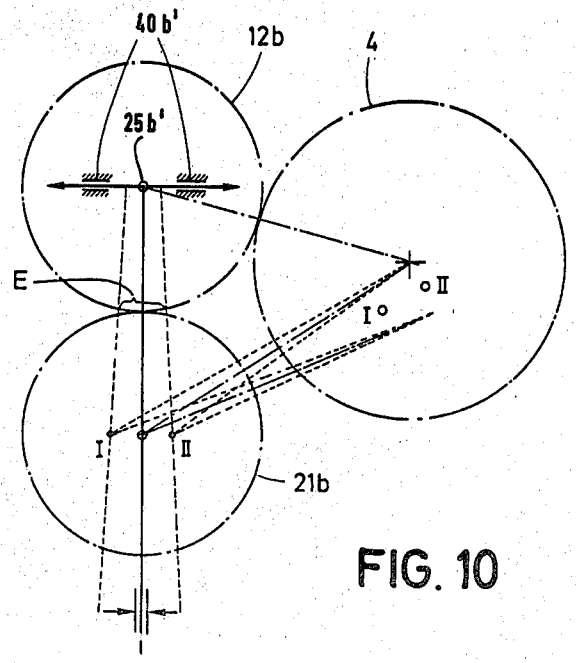

FIG. 6 is a perspective view showing in diagrammatic form the essential elements of the drive and of the means for adjusting one roll in the mill of FIG. 5, FIG. 7 is a detailed end view of the embodiment shown in diagrammatic form in FIG. 5, FIG. 8 is a detail of the mill of FIGS. 5 to 7, on an enlarged scale, FIG. 9 illustrates the principle of the detail of the first embodiment shown in FIG. 4, and FIG. 10 similarly illustrates the detail of the second embodiment illustrated in FIG. 8.

Figure 1:
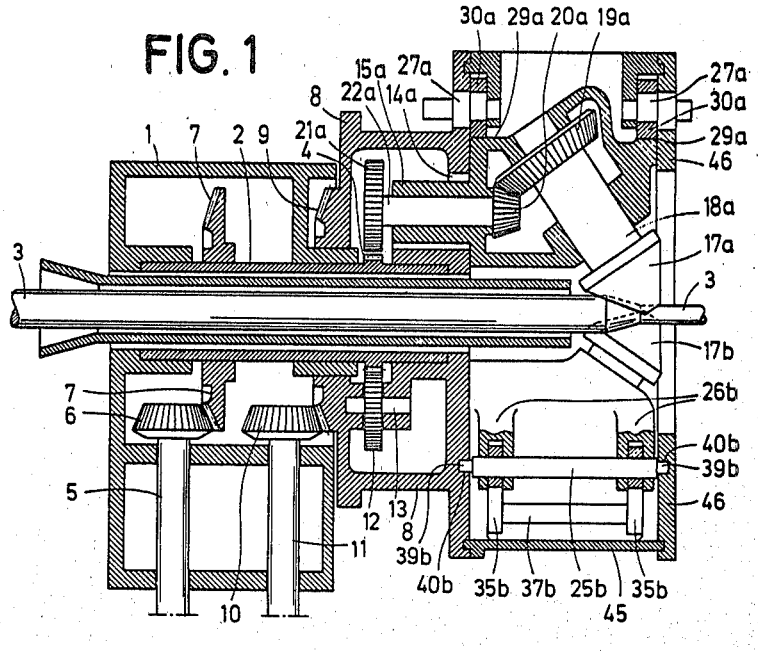
FIG. 1 is a diagrammatic longitudinal section of a skew rolling mill according to a first embodiment of the invention, on the line I—I shown in FIG. 3.
Figure 2:
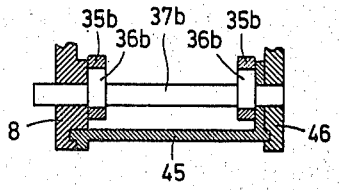
FIG. 2 shows part of a further longitudinal section along the line II—II of FIG. 3.
Figure 3:
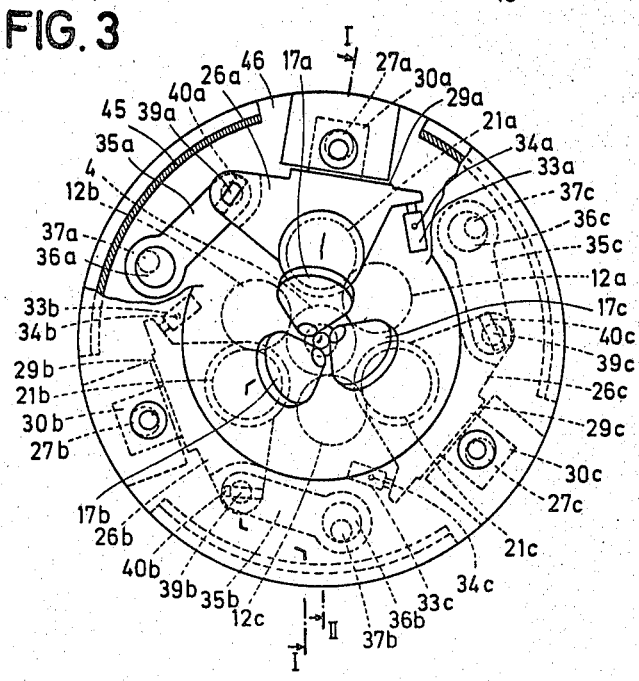
FIG. 3 is an end view of the rolling mill of FIGS. 1 and 2.

FIG. 1 shows the stand 1—also known as the stator—of a skew rolling mill. A hollow shaft 2 is rotatably supported by the stand 1, allows free axial passage through it of the rolled stock 3, and carries a sun wheel 4. The hollow shaft 2 and jointly therewith the sun wheel 4 are driven by a variable-speed motor (not shown), via a shaft 5 with a bevel pinion 6, and a bevel gear 7 which meshes with the pinion 6 and is fixedly mounted on the hollow shaft 2. The drive to the shaft 2 via the shaft 5 is an auxiliary drive by means of which the ratio between the rotational speed of the rolls 17 and of the roll support (rotor) 8 can be controlled. The roll support or rotor 8 is rotatably supported by the stand 1, on the hollow shaft 2. One end face of the roll support 8 is connected to a bevel gear ring 9, to provide rotation of the roll support, said bevel gear ring meshing with a pinion 10 on a shaft 11 which is driven by a drive, not shown. Planet gears 12*a*, 12*b*, 12*c* (FIG. 3) are rotatably supported on respective shafts 13 in the roll support 8 and mesh with the sun gear 4. The roll support 8 is also provided with three apertures 14 into each of which projects a respective extension 15 of one of three casings 16*a*, 16*b*, 16*c*. Each casing 16*a*, 16*b*, 16*c* supports one of the three tapered rolls 17*a*, 17*b*, 17*c*, which are arranged around the rolled stock at an angular distance of 120° from each other. Each roll 17 and the shaft 18 supporting it, a bevel gear 19 fixedly mounted on the shaft 18, a bevel pinion 20 which meshes with the bevel gear 19 and an intermediate shaft 22 which connects the bevel pinion 20 to an intermediate gear 21 and is supported by the extension 15 of the casing 16, are combined by the said casing 16 to form a roll head. (To indicate the position of the individual elements these are provided, like the casings and rolls, with indices a, b and c.) The intermediate gears 21 mesh with the planet gears 12 and, in the course of rotation of the roll support 8, the planet gears 12 roll upon the sun gear 4 so that the rolls 17 also rotate. This basic construction is identical in both exemplified embodiments of the invention and this part of the description therefore also applies to FIG. 5.

In the embodiment according to FIGS. 1 to 4 and 9 the roll head casings 16 are constructed as rockers, suspended by pivot pins 25, in order to allow the distance between the rolls 17 and the axis of the rolled stock 3 to be changed, and to this end the casings 16 are provided with rocker plates 26, as shown more particularly in FIG. 4 for the component parts with the indices b. Pivoting of the roll head casing 16 is effected by an eccentric 27. To this end, the rocker plates 26 of the roll head casings 16 are provided with support surfaces 29 on which sliding blocks 30 bear, which in turn are mounted on the eccentrics. Springs 33 which bear on abutments 34 of the roll support 8 and in an end ring 46 retain the roll head casing 16 in contact with the sliding blocks 30 of the adjusting eccentrics 27. The eccentrics 27 are arranged so that they are able to support the roll head casing 16 against the rolling pressure, so that this is substantially absorbed by the end ring 46. Rotation of the eccentrics 27 is provided by worm drives, not shown, which are drivingly connected to each other and are jointly driven by a motor. The use of self-arresting worm drives is recommended so as to dispense with separate locking devices.

Pivoting of the roll head casings 16 about the axes of pins 25 causes the skew position of the rolls 17 in relation to the axis of the rolled stock 3 and the meshing conditions between the intermediate gears 21 and the planet gears 12 to change. To provide compensation, the pins 25 are moved perpendicularly to the common plane of the axes of the associated intermediate gear 21 and the planet gear 12. To this end, each pin 25 is provided with guide studs 39 which engage in guide grooves 40 in the roll support 8 and the lantern-end ring 46 and are interconnected by means of push rods 35 which are jointly moved by eccentrics 36 of a common shaft 37. To provide joint adjustment of these pivot pins 25 the shafts 37 can be drivingly coupled to each other by means of worm drives (not shown) and can be jointly driven by a motor.

The end ring 46 is supported by a lantern-like extension 45 and is connected to the roll support 8.

FIG. 9 shows as a basic diagram the portion shown in FIG. 4 of the previously described embodiment. Another embodiment is shown in the basic diagram of FIG. 10 which is comparable with that of FIG. 9. In this second embodiment, shown in FIGS. 5 to 8 and 10, the roller casings 16 are also constructed as rockers, in this case suspended by pivot pins 25', to enable the distance between the rolls 17 and the axis of the rolled stock 3 to be changed, and to this end the casings 16 are provided with apertures 26', as shown more particularly in FIGS. 6 and 8, for the parts designated with the indices b. As a modification of the exemplified embodiment, the pivot pins 25' can be fixedly disposed, provided that the distance between the rolls 17 and the axis of the rolled stock 3 is to be changed only within relatively narrow limits. Pivoting of the roll head casings 16 is effected by eccentrics 27'. To this end, the roll head casings 16 are provided with outrigger arms 28' on whose support surfaces 29' bear sliding blocks 30' which are mounted on the eccentrics 27'. The eccentrics 27' are arranged so that they are able to support the roll head casings 16 against the rolling pressure so that the rolling pressure is substantially absorbed by the end ring 46'. As can be seen by reference to FIG. 7, rotation of the eccentrics 27' is effected by worm drives 31', which are transmissively connected to each other and are jointly driven by a motor 32. The use of self-arresting worm drives is recommended, to dispense with separate locking means.

Pivoting of the roll head casings about the pivot pins 25', which are approximately in alignment with the axes of the planet gears 12, leads to a change of the skew positions of the rolls 17 in relation to the axis of the rolled stock 3, but this is negligibly small for slight pivoting. To compensate any deviation of the skew position from the set position in the event of a more substantial pivoting motion, each pivot pin 25' is supported by a push rod 35' and is slidable together therewith in a direction parallel to the common tangent of the pitch circles of the associated planet gear 12 and intermediate gear 21, and provision is made for slight adjustment which does not impair the meshing between the planet gears 12 and the intermediate gears 21. Such parallel adjustment allows each skew position of the rolls to be returned to the set position as can be seen by the skew angles $\alpha$ of the two extreme positions shown in FIG. 8. To adjust the push rods 35, each of these has one end disposed on an eccentric 36' fixedly mounted on a shaft 37'. The shaft 37' is rotatably supported in bearings 38 and is driven by a drive, not shown. At the other end, the push rods 35' are guided by means of sliding blocks 39 in slotted link guides 40' which extend in the sliding direction of the push rods 35', i.e. parallel with the aforementioned tangents.

FIGS. 7 and 8 show an exemplified embodiment with modified details, where the eccentrics 41 for adjusting the push rods 35' form parts of worm drives 42 which are transmissively joined to each other and are jointly driven by a motor 43.

The roll support 8 is provided with a lantern-like extension 45' with an end ring 46' to support the eccentrics 36' with their shafts 37' or the eccentrics 41, to receive the slotted link guides 40' for the push rods 35' and for supporting the eccentrics 27', also the worm drives 31 and 42 and of the adjusting motors 32 and 43.

We claim:

1. A skew rolling mill for reducing solid or hollow stock, comprising a stand; a hollow shaft rotatably supported by the stand and adapted to permit the passage of the rolled stock therethrough; a driven roll support rotatable about said shaft; three driven, tapered working rolls mounted on said roll support, which are inclined relative to the axis of the rolled stock, are offset from one another by 120° and can be adjusted relative to the rolled stock axis; working roll support shafts mounted on said support and rotatably carrying said rolls, and of which the axes cross the rolled stock axis at short distances; intermediate shafts associated with said support shafts; bevel gears drivingly coupling each intermediate shaft to an associated support shaft; intermediate gears on said intermediate shafts; a sun gear disposed on the rotatable hollow shaft; planet gears meshing with said sun gear and with respective said intermediate gears, whereby the ratio between the working roll speed and the speed of rotation of the roll support can be controlled by rotation of the said sun wheel, so that the rolled stock will pass through the rolling mill without itself being rotated; each working roll together with its support shaft, the associated intermediate shaft and the associated bevel gears and intermediate gear, and a casing therefor, being combined to form a roll head, the roll heads being mounted on the roll support so as to be pivotable about axes which are parallel with the rolled stock axis, for adjusting the shaft angle between the roll axis and the rolled stock axis; characterised in that each roll head casing is constructed as a rocker which is provided with pivot means about which it is pivotable relative to the axes of the sun wheel, the planet gears and intermediate gears in a normal plane which is parallel with the end face of the roll support, and guide means are provided for supporting the pivot means of said rocker which guide means extends perpendicularly to the common plane of the axes of the respective intermediate gear supported by said rocker and the associated planet gear, the axis of the said pivot means being outside the axis of the associated intermediate gear and being at least approximately in the common plane of the axes of said intermediate gear and the associated planet gear, the pivot means being thereby adjustable to both sides of the said common plane of the axes within narrow limits to maintain meshing of the intermediate gear with the planet gear.

2. A skew rolling mill according to claim 1, characterised in that the guide means intersects with the axis of the planet gear.

3. A skew rolling mill according to claim 1, characterised in that the guide means is arranged diametrically with respect to the point of contact between the pitch circles of the intermediate gear and the planet gear.

4. A skew rolling mill according to claim 1, characterised in that each roll head casing has an extension with accommodates bearings for the intermediate shaft and is received in an aperture of the roll support for permitting adjustment of the roll head casing (16), a flange of said casing covers the said aperture of the roll support in each pivoted position of the roll head casing, and means are provided for clamping the said roll head casing by means of its flange against the end face of the roll support.

5. A skew rolling mill according to claim 4, characterised in that the roll support is provided with a lantern-like extension which is closed by an end ring and the end ring as well as the roll support have parallel surfaces which face each other and between which the roll head casings are pivotably guided as rockers.

6. A skew rolling mill according to claim 5, characterised in that the pivot means of the rockers are disposed in said guides which are provided on the roll support and on the lantern end ring, and can be adjusted by means of push rods by eccentrics which act uniformly and in the same sense.

7. A skew rolling mill according to claim 6, characterised in that two eccentrics are provided for adjusting each pivot means and are disposed on a common shaft which is supported by the lantern-like extension.

8. A skew rolling mill according to claim 1, characterised in that each roll head casing is associated with an adjusting device for pivoting the roll head casing.

9. A skew rolling mill according to claim 8, characterised in that the adjusting device supports the casing of the roll head against the rolling pressure, and a spring is provided for keeping the casing (16) of the roll head in contact with the adjusting device.

10. A skew rolling mill according to claim 5 characterized in that each roll head casing is associated with an adjusting device for pivoting the roll head casing, and said adjusting devices, transmissively joined to each other for actuation which is uniform and in the same sense, are provided on the end face of the roll support and on the end ring of the lantern-like extension.

11. A skew rolling mill according to any of claims 6 to 10, characterised in that the said means for adjusting the pivot means, and the said adjusting devices for pivoting the roll head casings can each be transmissively coupled to the other.

12. A skew rolling mill for reducing solid or hollow stock, comprising a stand; a hollow shaft rotatably supported by the stand and adapted to permit the passage of the rolled stock therethrough; a driven roll support rotatable about said shaft; three driven, tapered working rolls mounted on said roll support, which are inclined relative to the axis of the rolled stock, are offset from one another by 120° and can be adjusted relative to the rolled stock axis; working roll support shafts mounted on said support and rotatably carrying said rolls, and of which the axes cross the rolled stock axis at short distances; intermediate shafts associated with said support shafts; bevel gears drivingly coupling each intermediate shaft to an associated support shaft; intermediate gears on said intermediate shafts; a sun gear disposed on the rotatable hollow shaft; planet gears meshing with said sun gear and with respective said intermediate gears, whereby the ratio between the working roll speed and the speed of rotation of the roll support can be controlled by rotation of the said sun wheel, so that the rolled stock will pass through the rolling mill without itself being rotated; each working roll together with its support shaft, the associated intermediate shaft and the associated bevel gears and intermediate gear, and a casing therefor, being combined to form a roll head, the roll heads being mounted on the roll support so as to be pivotable about axes which are parallel with the rolled stock axis, for adjusting the shaft angle between the roll axis and the rolled stock axis, characterised in that each roll head casing is constructed as a rocker which is pivotable about an axis substantially coincident with the axis of the associated planet gear.

* * * * *